US008287319B2

(12) United States Patent
Falchetti

(10) Patent No.: US 8,287,319 B2
(45) Date of Patent: Oct. 16, 2012

(54) CLAMP FOR MALE TERMINAL

(75) Inventor: Antonio Falchetti, Codogno (IT)

(73) Assignee: MTA S.p.A., Codogno (LO) (IT)

( * ) Notice: Subject to any disclaimer, the term of this patent is extended or adjusted under 35 U.S.C. 154(b) by 20 days.

(21) Appl. No.: 13/076,927

(22) Filed: Mar. 31, 2011

(65) Prior Publication Data

US 2011/0269354 A1 Nov. 3, 2011

(30) Foreign Application Priority Data

Mar. 31, 2010 (EP) ..... 10425105

(51) Int. Cl.
*H01R 4/50* (2006.01)

(52) U.S. Cl. ..... 439/773; 439/765

(58) Field of Classification Search ..... 439/772, 439/773, 769, 770, 765
See application file for complete search history.

(56) References Cited

U.S. PATENT DOCUMENTS

| | | | | |
|---|---|---|---|---|
| 3,568,139 | A * | 3/1971 | Delzer | 439/759 |
| 5,486,434 | A | 1/1996 | Aoyama | |
| 5,503,574 | A * | 4/1996 | Louridas | 439/767 |
| 5,588,883 | A * | 12/1996 | Hattori | 439/761 |
| 6,776,669 | B2 * | 8/2004 | Krause et al. | 439/772 |
| 6,872,099 | B2 | 3/2005 | Cret | |
| 6,872,101 | B2 * | 3/2005 | Daugherty et al. | 439/769 |
| 6,875,061 | B2 * | 4/2005 | Daugherty et al. | 439/769 |
| 6,971,925 | B1 * | 12/2005 | Orange | 439/773 |
| 2001/0051469 | A1 | 12/2001 | Murakami et al. | |
| 2004/0161980 | A1 | 8/2004 | Cret | |
| 2007/0066149 | A1 | 3/2007 | Fujii | |
| 2008/0274639 | A1 | 11/2008 | Sikora | |
| 2009/0191454 | A1 | 7/2009 | Detter et al. | |

FOREIGN PATENT DOCUMENTS

FR 2 782 198 2/2000

OTHER PUBLICATIONS

EP Search Report for EP Application No. 10 42 5105, dated Aug. 18, 2010.

* cited by examiner

*Primary Examiner* — Gary F. Paumen
(74) *Attorney, Agent, or Firm* — Nixon & Vanderhye PC

(57) ABSTRACT

A clamp (1) for male terminal comprises a first tightening ring (21), a second tightening ring (31) constrained to the first tightening ring so as to rotate relative thereto about a rotation axis (Z-Z) extending perpendicularly to the axis of the first ring (A-A) so as to be mobile between a loosened position and a tightened position respectively for loosening and tightening the clamp on the male terminal, tightening means (40) actuable for moving the second tightening ring between the loosened position and the tightened position so as to vary the angle comprised between the axes of the two tightening rings (A-A, B-B). In particular, the second tightening ring (31) is shaped so that, in the tightened position, it surrounds at least one portion of the first tightening ring and acts on said portion for determining the tightening of the first ring on the male terminal.

12 Claims, 7 Drawing Sheets

CLAMP FOR MALE TERMINAL

TECHNICAL FIELD

The present invention relates to a clamp for a male terminal.

The clamp of the present invention may be applied for the connection to a battery pole. In this case, the male terminal is a battery pole while the clamp is connected to one or more utilities of a motor vehicle.

According to a different application, the clamp of the present invention may be applied for grounding electrical and/or electronic devices. In this case, the male terminal is a ground terminal fastened to a structure acting as ground, whereas the ground connection of the devices to be grounded is connected to the clamp by an electrical cable. The structure acting as ground may be, for example, the body of a motor vehicle, in particular of a car.

BACKGROUND OF THE INVENTION

Clamps for battery pole are known in the art and are described, for example, in US 2001/51469, EP 1 450 441, FR 2 782 198 and U.S. Pat. No. 3,568,139.

A further clamp for battery pole is described in the published patent application US 2009/191454.

Application US 2009/191454 describes a clamp for battery terminal which comprises a fixed ring that cooperates with an adjustable ring for engaging a battery terminal. The adjustable ring is fastened to a pivotal tightening plate extending from the ring to a hinge point wherein the plate connects to the fixed ring. The tightening plate further comprises a tab that inserts into a slit of the fixed ring so as to rotate about the hinge point when a force is applied thereon. In the example, the force is applied by a screw-nut tightening system arranged between the hinge point and the fixed ring.

Such clamp exhibits some drawbacks.

In fact, it should be noted that the pressure exerted by the clamp on the battery terminal is concentrated in two limited areas, exactly at the contact area of the adjustable ring portion with the battery terminal at the contact area of the fixed ring portion opposite that of the adjustable ring relative to the battery terminal. Hence, unevenness results in the pressure exerted by the clamp, in particular by the two rings, on the battery terminal and as a consequence, an unevenness of the electrical contact between the battery terminal and the clamp and the relevant electrical utilities connected thereto.

From the above description there clearly exists a need for providing a clamp for male terminal ensuring optimum electrical continuity with the male terminal.

SUMMARY OF THE INVENTION

The object of the present invention therefore is to provide a clamp for male terminal exhibiting such features as to meet the above need while overcoming the drawbacks mentioned with reference to the prior art.

Such object is achieved by a clamp for male terminal comprising a first tightening ring, having a first axis, said first tightening ring being suitable for insertion onto a male terminal according to an insertion direction extending along said axis, a second tightening ring having a second axis, said second tightening ring being constrained to said first tightening ring so as to rotate relative thereto about a rotation axis extending perpendicularly to said first axis so as to be mobile between a loosened position and a tightened position respectively for loosening and tightening the clamp on the male terminal, tightening means actuable for moving said second tightening ring between said loosened position and said tightened position, wherein, in the movement of the second tightening ring between said loosened position and said tightened position, the angle comprised between the first axis and the second axis changes and wherein said second tightening ring is shaped so that, in said tightened position, it surrounds at least one portion of said first tightening ring and acts on said at least one portion of first tightening ring for determining the tightening of said first tightening ring on the male terminal.

Thanks to the fact of having two tightening rings wherein one tightening ring is shaped so that, in the clamped position, it surrounds at least one portion of the other tightening ring and acts on such portion for determining the tightening on the male terminal, the clamp of the present invention ensures optimum electrical continuity with the male terminal.

BRIEF DESCRIPTION OF THE DRAWINGS

Further features and advantages of the clamp according to the present invention will appear more clearly from the following description of a preferred embodiment thereof, given by way of a non-limiting example with reference to the annexed figures, wherein.

DETAILED DESCRIPTION OF ONE EMBODIMENT OF THE INVENTION

Figure 1:
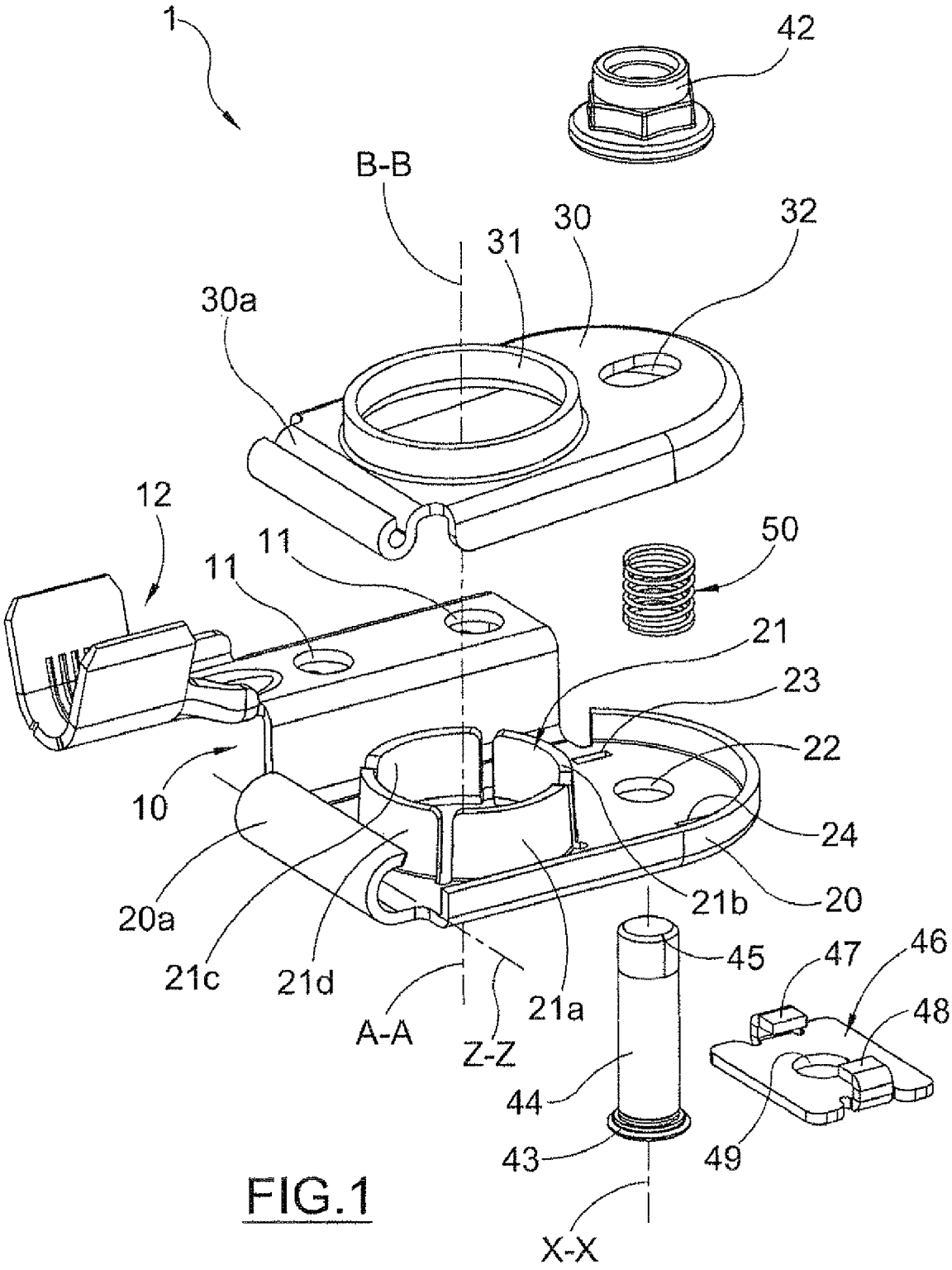
FIG. 1 shows an exploded view of a first embodiment of a clamp according to the present invention.

With reference to FIGS. 1 to 11, reference numeral 1 globally indicates a clamp according to a first embodiment of the present invention.

Clamp 1 comprises a support element 10 provided with means 11 for fastening clamp 1 into a suitable seat and means 12 for the electrical connection of clamp 1 to one or more electrical utilities.

Clamp 1 further comprises a first tightening ring 21, having a first axis A-A, and suitable for insertion on a male terminal (not shown in the figures) according to an insertion direction extending along axis A-A.

According to an embodiment, the first tightening ring 21 is fastened to the support element 2.

Clamp 1 further comprises a second tightening ring 31 having a second axis B-B. The second tightening ring 31 is constrained to the first tightening ring 21 so as to rotate relative thereto about a rotation axis Z-Z extending perpendicular to axis A-A so as to be mobile between a loosened position (FIGS. 2-6 and FIGS. 13-17) and a tightened position (FIGS. 7-11 and FIGS. 18-22), respectively for loosening and tightening clamp 1 on the male terminal. According to an embodiment, the first tightening ring 21 extends along its axis A-A from a first tightening plate 20 whereas the second tightening ring 31 extends along its axis B-B from a second tightening plate 30.

In this case, axis A-A is perpendicular to the plane of the first tightening plate 20 and axis B-B is perpendicular to the plane of the second tightening plate 30.

The two tightening plates 20 and 30 are constrained to one another at a respective constraining end portion 20*a* and 30*a* so that the second tightening plate 30 may rotate relative to the first tightening plate 20 about the rotation axis Z-Z.

Figure 1A:
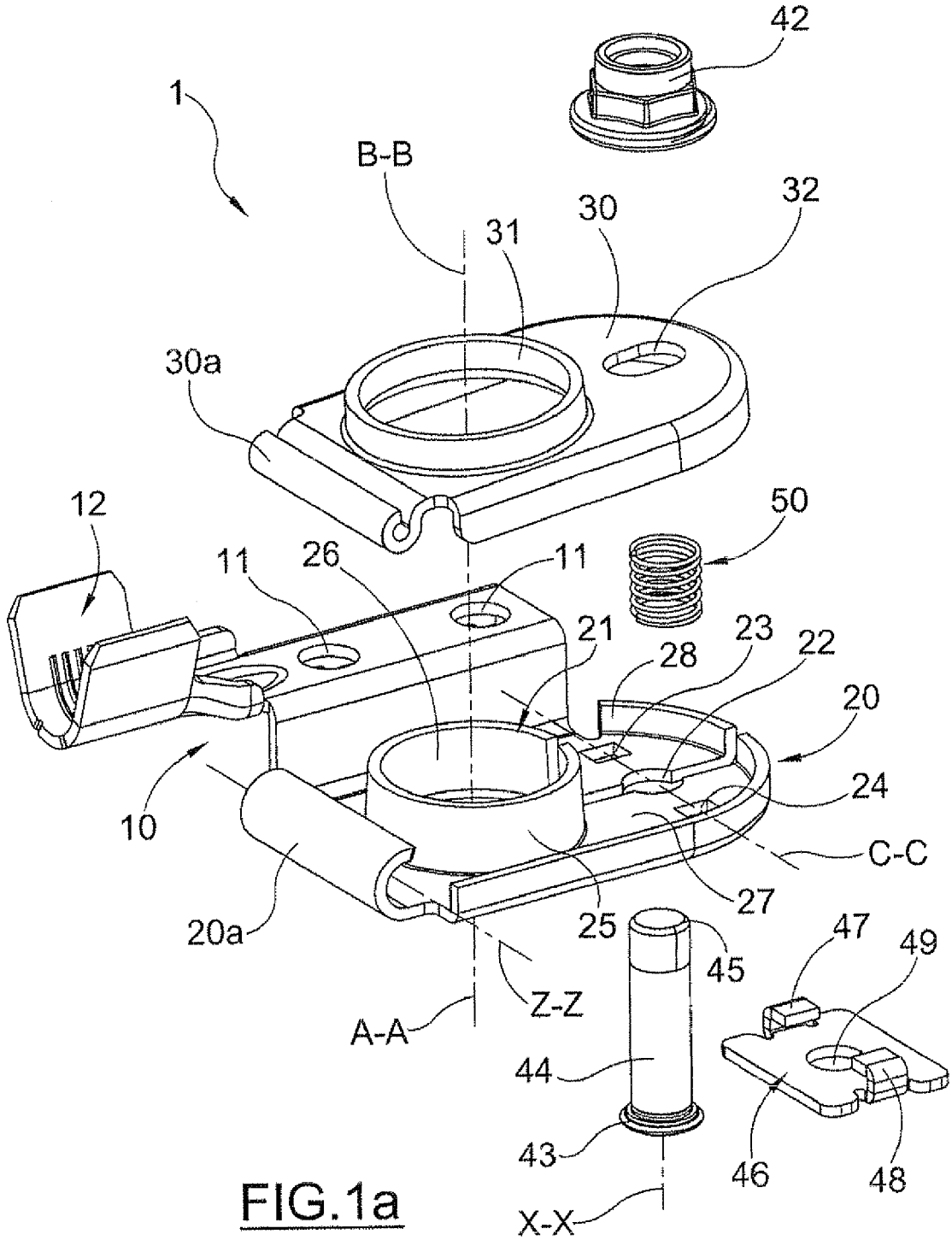
FIG. 1*a* shows an exploded view of a different embodiment of the clamp of FIG. 1.
Figure 3:
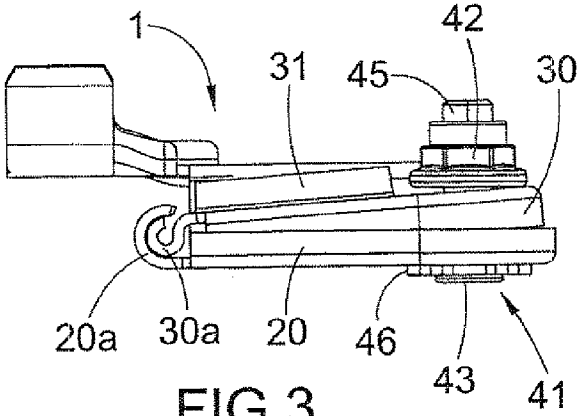
FIGS. 3-5 show different plane views of the clamp of FIG. 2.
Figure 4:
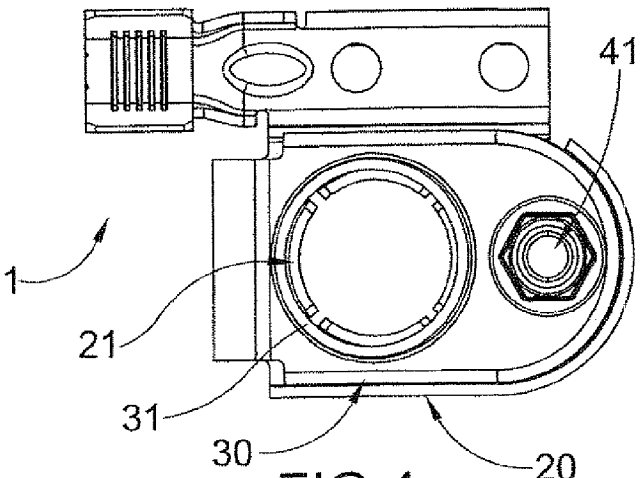
Figure 6:
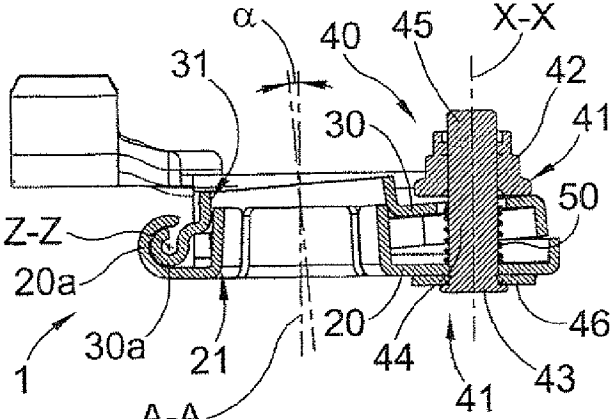
FIG. 6 shows a cross section view of the clamp of FIG. 2, along the section line A-A of FIG. 5.
Figure 2:
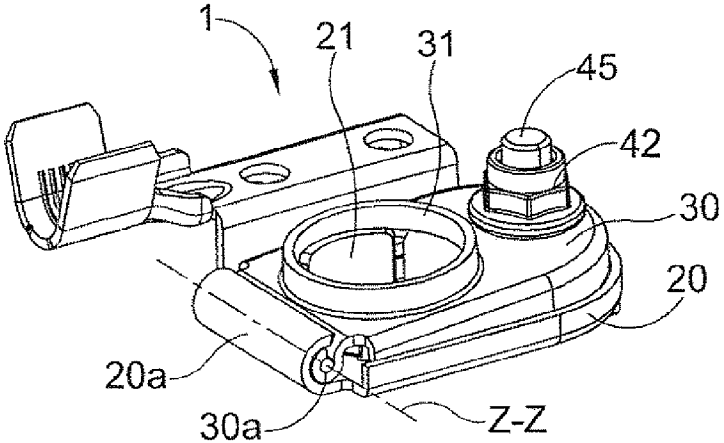
FIG. 2 shows a perspective view of the clamp of FIG. 1 in open configuration.
Figure 5:
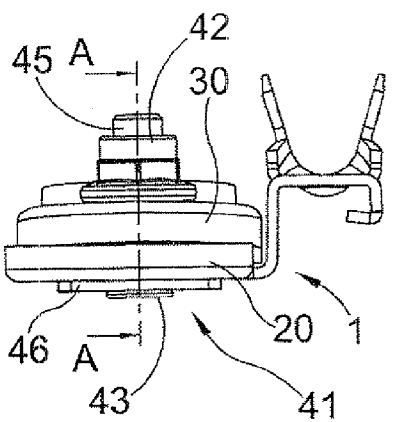
Figure 8:
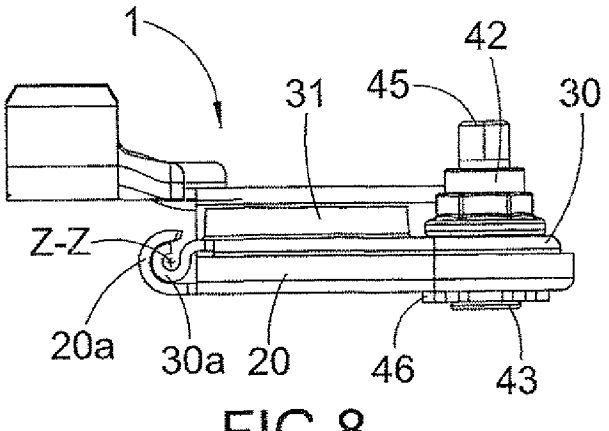
FIGS. 8-10 show different plane views of the clamp of FIG. 7.
Figure 9:
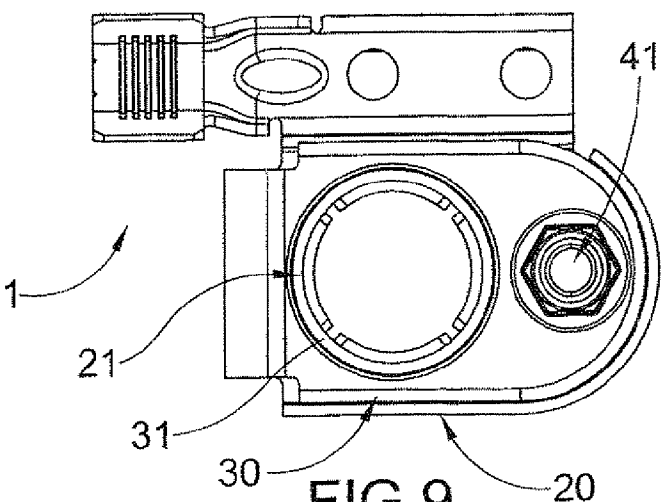
Figure 11:
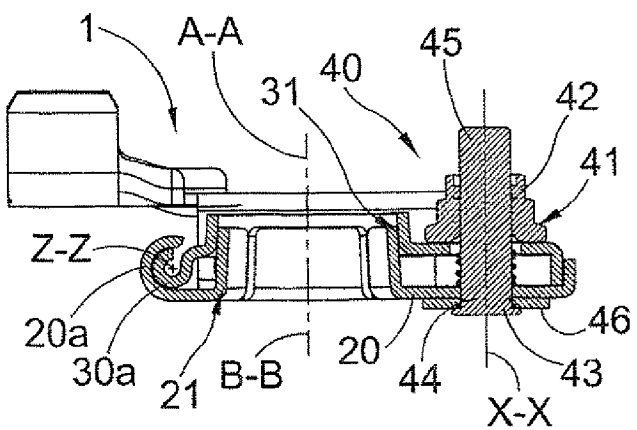
FIG. 11 shows a cross section view of the clamp of FIG. 7, along the section line A-A of FIG. 10.
Figure 7:
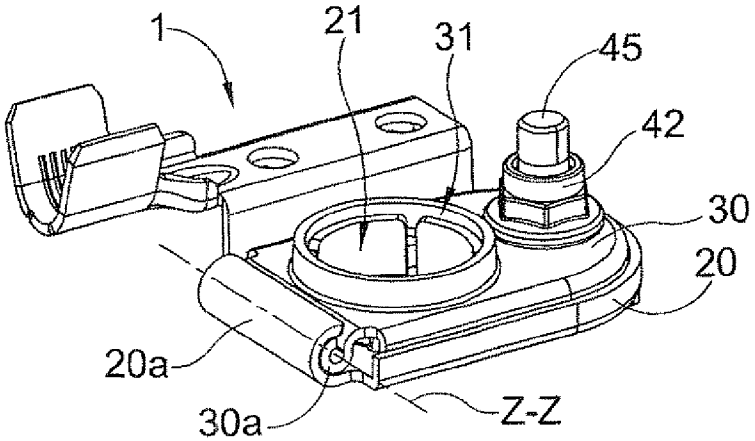
FIG. 7 shows a perspective view of the clamp of FIG. 1 in closed configuration.
Figure 10:
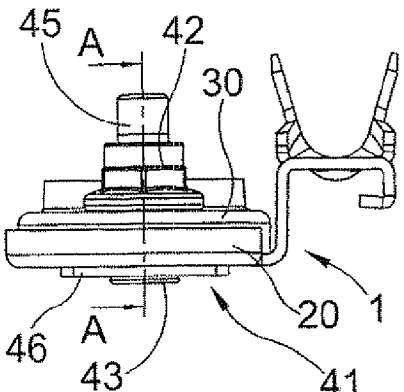
Figure 12:
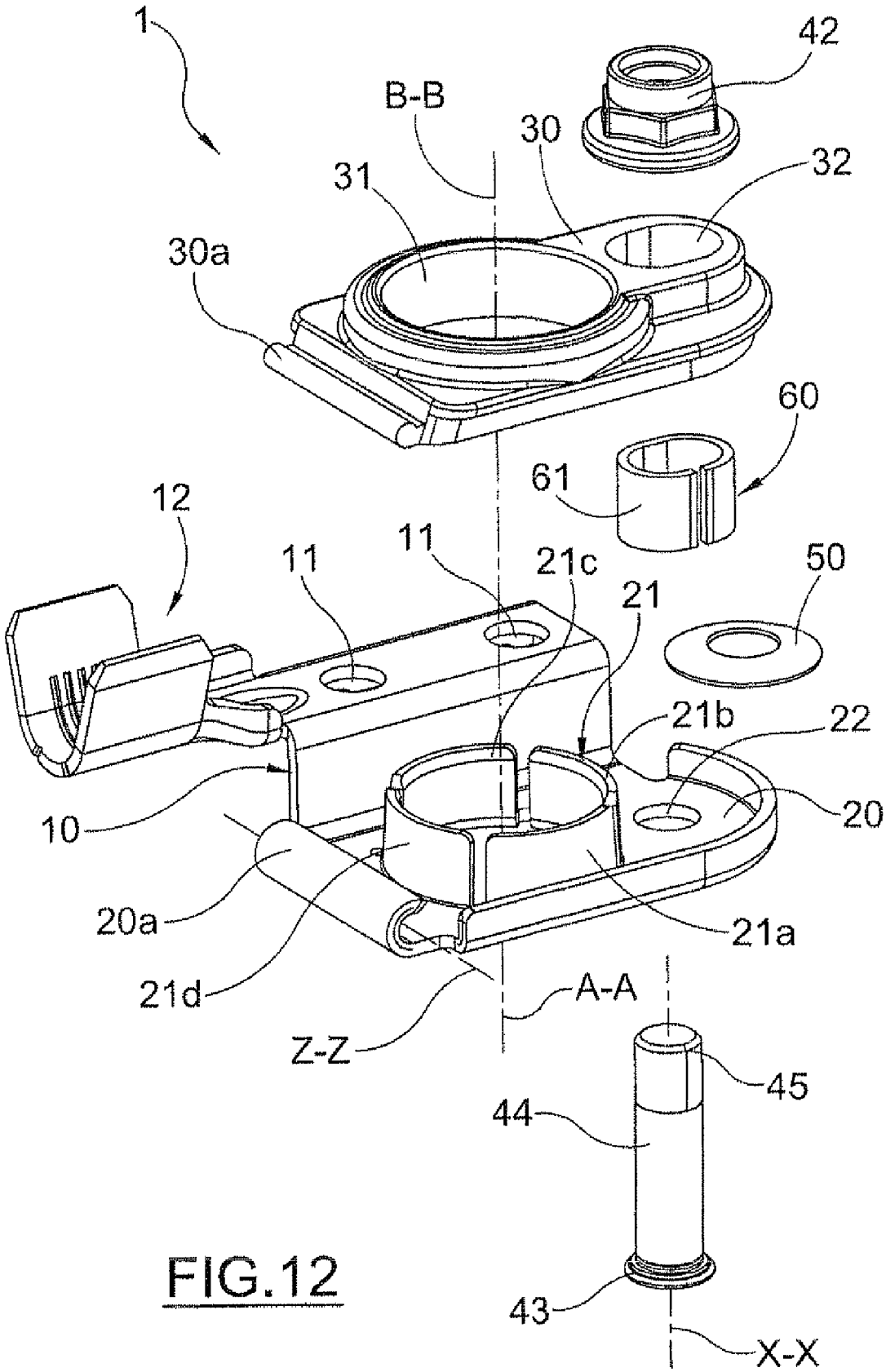
FIG. 12 shows an exploded view of a second embodiment of a clamp according to the present invention.
Figure 14:
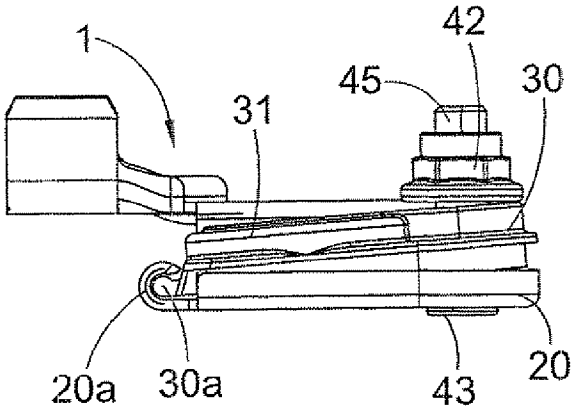
FIGS. 14-16 show different plane views of the clamp of FIG. 13.
Figure 15:
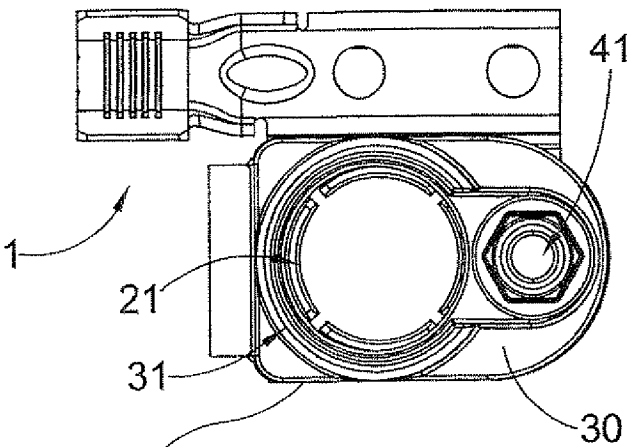
Figure 17:
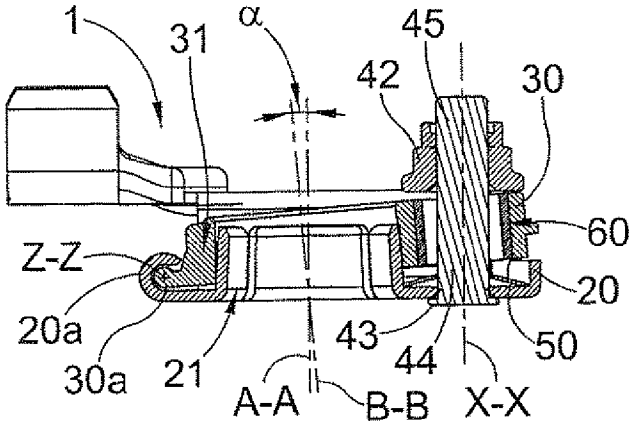
FIG. 17 shows a cross section view of the clamp of FIG. 13, along the section line A-A of FIG. 16.
Figure 13:
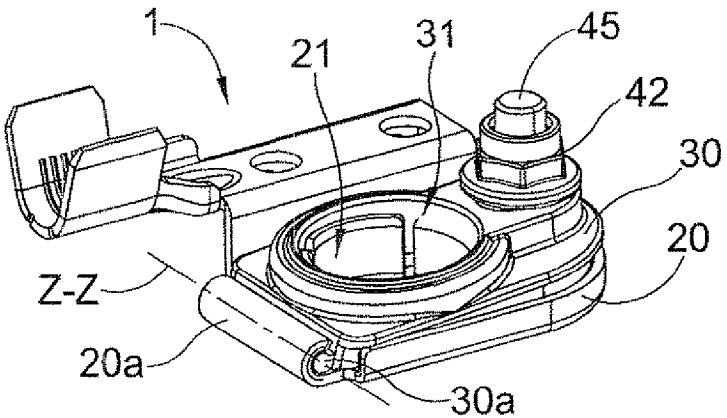
FIG. 13 shows a perspective view of the clamp of FIG. 1 in open configuration.
Figure 16:
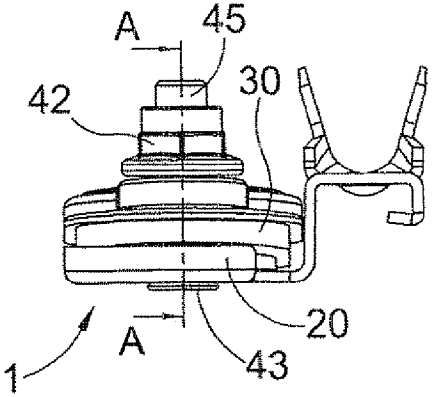
Figure 19:
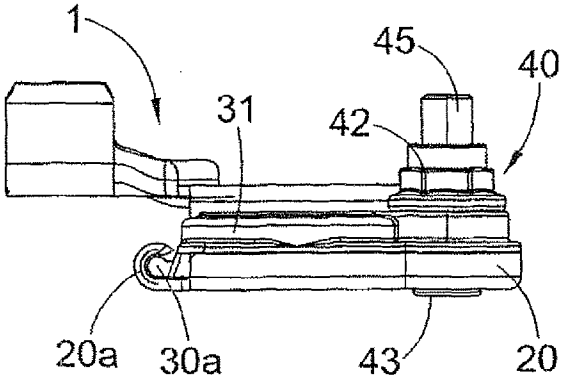
FIGS. 19-21 show different plane views of the clamp of FIG. 18.
Figure 20:
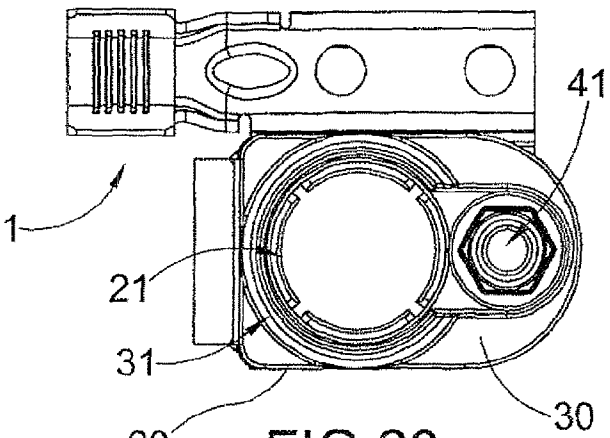
Figure 22:
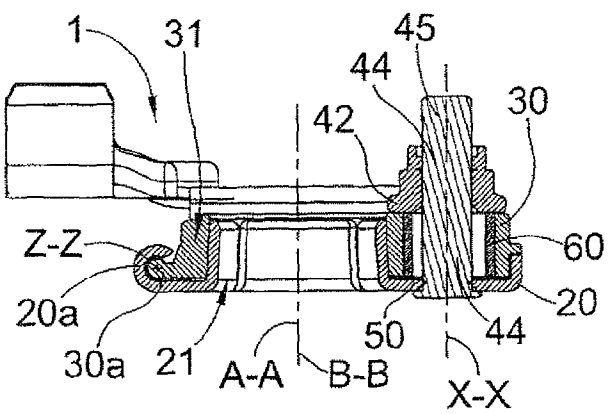
FIG. 22 shows a cross section view of the clamp of FIG. 18, along the section line A-A of FIG. 21.
Figure 18:
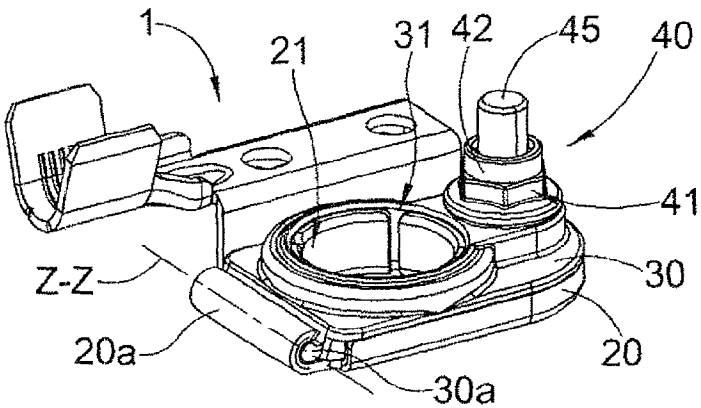
FIG. 18 shows a perspective view of the clamp of FIG. 12 in closed configuration.
Figure 21:
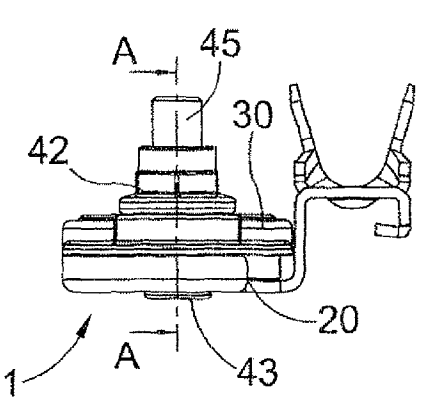

According to the different embodiment shown in FIG. 1*a*, the first tightening plate 20 comprises two jaws 27, 29, connected to the first tightening ring 21 and reciprocally movable close to each other, along a direction C-C perpendicular to axis A-A, in the example parallel to the rotation axis Z-Z, for tightening the first tightening ring 21 about the male terminal. In this case, the first tightening ring 21 comprises two ring portions 25, 26 each fixed to a respective jaw 27, 28.

Clamp 1 further comprises tightening means 40 actuable for moving the second tightening ring 31 between the loosened position and the tightened position.

In particular, in the rotation movement of the second tightening ring 31 between the loosened position and the tightened position, the angle comprised between axis A-A and axis B-B varies.

According to an embodiment, when the second tightening ring 31 is in the tightened position, axis B-B of the second tightening ring 31 is parallel to or in axis with axis A-A of the first tightening ring 21.

As an alternative, when the second tightening ring 31 is in the tightened position, the angle comprised between axis B-B of the second tightening ring 31 and axis A-A of the first tightening ring 21 is smaller than the angle comprised between the above axes B-B and A-A when the second tightening ring 31 is in the loosened position.

The second tightening ring 31 is shaped so that, in the tightened position thereof, it surrounds at least one portion of the first tightening ring 21 and acts on said at least one portion for determining the tightening of the first tightening ring 21 on the male terminal. In this way, the electrical contact is provided by the first tightening ring 21, directly in contact with the male terminal, and ensured by the second tightening ring 31 that acts on at least one portion of the first tightening ring 21. Such configuration therefore allows ensuring optimum electrical continuity between the male terminal and the clamp and the electrical utilities connected thereto.

According to an embodiment, the second tightening ring 31 is shaped so that, in the tightened position thereof, it surrounds the first tightening ring 21, substantially by the entire extension thereof, and acts thereon for determining the tightening thereof on the male terminal.

According to an embodiment, the first tightening ring 21 is defined by a plurality of ring portions 21*a*, 21*b*, 21*c*, 21*d* arranged contiguous so as to substantially define a closed ring having a contact surface that may be considered as substantially continuous. In fact, it should be noted that in the attached drawings, the distance between the edges of the ring portions 21*a*-21*d* is accentuated for the sake of clarity of the figures only. The second tightening ring 31 is formed of a closed ring.

It should be noted that the tightening of the second ring 31 on the first ring 21 is obtained by suitably selecting the diameter of the same so that, in the rotation movement of the second tightening ring 31 between the loosened position and the tightened position, the inner surface of the second ring 31, facing the male terminal, engages the outer surface of the first ring 21, facing the inner surface of the second ring 31.

Thus configured, in the movement from the loosened position to the tightened position, the second tightening ring 31 surrounds and acts in engagement on the ring portions 21*a*-21*d* and presses the same against the male terminal for obtaining the tightening of clamp 1.

The two tightening rings 21 and 31, moreover, must adapt to the shape of the male terminal.

Therefore, if clamp 1 is intended for tightening conical male terminals, the two tightening rings 21 and 31 will be conical as well, with suitably selected taper so that, in the tightened position, the second tightening ring 31 acts on the first tightening ring 21 for determining the tightening thereof on the male terminal.

In the case of the version of FIG. 1*a*, in the movement from the loosened position to the tightened position, the second tightening ring 31 surrounds and acts in engagement on the two ring portions 25, 26 of the first tightening ring 21 and presses the same against the male terminal for obtaining the tightening of clamp 1. Since the two jaws 27, 28 are reciprocally movable close to each other, the tightening of the two ring portions 25, 26 fixed thereto is improved.

According to an embodiment, the tightening means 40 comprise a tightening member 41 rotatable about a tightening axis X-X extending parallel to or in axis with axis A-A for determining the rotation of the second tightening ring 31 relative to the first tightening ring 21 about the rotation axis Z-Z between the loosened position and the tightened position.

According to an aspect, the tightening member 41 is arranged, relative to the two tightening rings 21, 31, opposite the rotation axis Z-Z, in the example opposite the constraining portion 20*a*, 30*a* of the two tightening plates 20, 30. This allows reducing the effort required for obtaining the rotation of the second ring 31 relative to the first ring 21 from the loosened position to the tightened position and thus reducing the effort required for obtaining the tightening of clamp 1 on the male terminal.

According to an embodiment, the constraining portions 20*a*, 30*a* define a hinging zone between the two tightening plates 20, 30.

Tightening member 41 comprises a first portion 42 actuable in rotation and suitable for engaging the second tightening plate 30 and a second portion 43 suitable for engaging the first tightening plate 20 so that the rotation of the portion actuable in rotation of the tightening screw determines the rotation of the second tightening ring 31 relative to the first tightening ring 21 about the rotation axis Z-Z between the loosened position and the tightened position.

In the example shown in the figures, the tightening member 41 comprises a screw 44 having a first end 45 whereon there is mounted a nut 42 actuable in rotation and the second end 43 engaged with the first tightening plate 21.

In order to allow the passage of screw 44, the tightening plates 20, 30 have respective through holes 22, 32. Each hole 22, 32 is obtained on the side opposite the constraining portion 20*a*, 30*a* relative to the corresponding tightening ring 21, 31 so that the tightening member 41 is arranged, relative to the two tightening rings 21, 31, opposite the rotation axis Z-Z.

In the example, hole 22 is a circular hole whereas hole 32 is a slot-shaped elongated hole for allowing the sliding of screw 44 during the rotation movement of the second tightening plate 30.

According to an embodiment, the tightening means 40 further comprises a reinforcing element 46 arranged between the second portion 43 of the tightening member 41 and the second tightening plate 31 and coupled to the second tightening plate 31.

In the example shown in the attached figures, the reinforcing element 46 is a plate provided with hooking teeth 47, 48 bent as a C and suitable for engaging corresponding openings 23, 24 obtained in the first tightening plate 21. The reinforcing element 46 further exhibits a hole 49 for the passage of the second end 43 of screw 44. In this case, the second end 43 of screw 44 engages the first tightening plate 20 with the interposition of the reinforcing element 46.

In order to facilitate the movement of the second tightening ring 31 from the tightened position to the loosened position, during the loosening of the tightening means 40, in the example during the loosening of the tightening nut 42, there may be provided elastic means 50, in the examples of FIGS. 1 to 11 a helical spring whereas in the examples of FIGS. 12 to 22 a Belleville washer, arranged between the first tightening plate 20 and the second tightening plate 30 for acting in contrast to the tightening action of said tightening means 40. Such elastic means 50 therefore opposes the tightening action of the tightening means 40 and, during the loosening of the same, they facilitate the passage of the second tightening plate 30 and thus, of the second tightening ring 31 from the tightened position to the loosened position for releasing clamp 1 from the male terminal.

According to the embodiment shown in FIGS. 1 to 11, the two tightening plates 20 and 30 are made of an electrically conductive material, for example tinned brass.

As an alternative, as shown in FIGS. 12 to 22, the first tightening plate 20 is made of an electrically conductive material whereas the second tightening plate 30 may be made of an electrically insulating material, for example plastic material.

According to one embodiment, clamp 1 comprises tightening limiting means 60 interposed between the first tightening plate 20 and portion 42 actuable in rotation. In the example, the tightening limiting means comprises a metal tubular element 61 inserted in the through hole 32 and extending substantially by the entire axial extension of hole 32 itself. In the example shown in the figures, the tubular element 61 comprises a metal plate bent so as to form an inner coating of hole 32. The metal tubular element 61 allows limiting the screwing stroke of nut 42 on screw 44 so as to prevent damaging the plastic material the second tightening plate 30 is made of.

As it can be understood from the description, the clamp according to the present invention allows overcoming the drawbacks mentioned with reference to the prior art.

Of course, a man skilled in the art may make several changes and variations to the clamp according to the invention in order to meet specific and incidental needs, all falling within the scope of protection defined in the following claims.

The invention claimed is:

1. Clamp for male terminal, comprising:

a first tightening ring, having a first axis, said first tightening ring being suitable for insertion onto a male terminal according to an insertion direction extending along said axis, a second tightening ring having a second axis, said second tightening ring being constrained to said first tightening ring so as to rotate relative thereto about a rotation axis extending perpendicularly to said first axis so as to be mobile between a loosened position and a tightened position respectively for loosening and tightening the clamp on the male terminal, tightening means actuable for moving said second tightening ring between said loosened position and said tightened position, wherein, in the movement of the second tightening ring between said loosened position and said tightened position, the angle comprised between the first axis and the second axis changes, wherein said second tightening ring is shaped so that, in said tightened position, it surrounds at least one portion of said first tightening ring and acts on said at least one portion of first tightening ring for determining the tightening of said first tightening ring on the male terminal.

2. Clamp according to claim 1, wherein said second tightening ring is shaped so that, in said tightened position, it surrounds said first tightening ring, substantially by the entire circumferential extension thereof, and acts on said first tightening ring for determining the tightening of said first tightening ring on the male terminal.

3. Clamp according to claim 1, wherein said first tightening ring and said second tightening ring extend along their axis respectively from a first and from a second tightening plate, said first and second tightening plate being constrained to each other at a respective constraining end portion so that said second tightening plate is constrained to said first tightening plate so as to rotate relative thereto about said rotation axis.

4. Clamp according to claim 2, wherein said first tightening ring and said second tightening ring extend along their axis respectively from a first and from a second tightening plate, said first and second tightening plate being constrained to each other at a respective constraining end portion so that said second tightening plate is constrained to said first tightening plate so as to rotate relative thereto about said rotation axis.

5. Clamp according to claim 1, wherein said tightening means comprise a tightening member rotatable about a tightening axis extending parallel to said first axis for determining the rotation of said second tightening ring relative to said first tightening ring about said rotation axis between the loosened position and the tightened position.

6. Clamp according to claim 2, wherein said tightening means comprise a tightening member rotatable about a tightening axis extending parallel to said first axis for determining the rotation of said second tightening ring relative to said first tightening ring about said rotation axis between the loosened position and the tightened position.

7. Clamp according to claim 3, wherein said tightening means comprise a tightening member rotatable about a tightening axis extending parallel to said first axis for determining the rotation of said second tightening ring relative to said first tightening ring about said rotation axis between the loosened position and the tightened position.

8. Clamp according to claim 5, wherein said tightening member is arranged, relative to said first and second tightening ring, opposite said rotation axis.

9. Clamp according to claim 5, wherein said rotatable tightening member comprises a first portion actuable in rotation and suitable for engaging said second tightening plate and a second portion engaged with said first tightening plate, the rotation of said first portion actuable in rotation determining the rotation of said second tightening ring relative to said first tightening ring about said rotation axis between the loosened position and the tightened position.

10. Clamp according to claim 5, wherein said tightening means comprises a reinforcing element arranged between said second portion of the tightening member and said second tightening plate and coupled to said second tightening plate.

11. Clamp according to claim 3, comprising elastic means arranged between said first and second tightening plate for acting in contrast to the tightening action of said tightening means so as to facilitate, during the loosening of the tightening means, the movement of the second tightening ring from the tightened position to the loosened position.

12. Clamp according to claim 1, wherein said first tightening plate is made of an electrically conductive material whereas said second tightening plate is made of an electrically insulating material.

* * * * *